US007686649B2

(12) United States Patent
Pepe et al.

(10) Patent No.: US 7,686,649 B2
(45) Date of Patent: Mar. 30, 2010

(54) ELECTRICAL CONNECTOR WITH COMPENSATION COMPONENT

(75) Inventors: Paul John Pepe, Clemmons, NC (US); Shawn Phillip Tobey, Trinity, NC (US); Sheldon Easton Muir, Whitsett, NC (US); Steven Richard Bopp, Jamestown, NC (US); James Shannon Hower, Harrisburg, PA (US); Neil Ktul Nay, Greensboro, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/134,948

(22) Filed: Jun. 6, 2008

(65) Prior Publication Data

US 2009/0305563 A1 Dec. 10, 2009

(51) Int. Cl.
*H01R 13/66* (2006.01)

(52) U.S. Cl. ..... 439/620.11; 439/620.21; 439/676

(58) Field of Classification Search ..... 439/676, 439/941, 620.11, 620.18, 620.21, 620.23; 39/620.17

See application file for complete search history.

(56) References Cited

U.S. PATENT DOCUMENTS

| | | | | |
|---|---|---|---|---|
| 4,863,393 | A * | 9/1989 | Ward et al. | 439/188 |
| 5,139,442 | A * | 8/1992 | Sakamoto et al. | 439/620.19 |
| 6,176,742 | B1 * | 1/2001 | Arnett et al. | 439/620.23 |
| 6,186,834 | B1 | 2/2001 | Arnett et al. | |
| 6,409,547 | B1 | 6/2002 | Reede | |
| 6,558,207 | B1 * | 5/2003 | Pepe et al. | 439/862 |
| 6,786,772 | B1 * | 9/2004 | Liu | 439/620.06 |
| 6,916,209 | B1 * | 7/2005 | Casher et al. | 439/676 |
| 6,964,585 | B2 * | 11/2005 | Blichasz et al. | 439/638 |
| 6,964,587 | B2 * | 11/2005 | Colantuono et al. | 439/676 |
| 7,407,417 | B2 * | 8/2008 | Pepe et al. | 439/676 |
| 2004/0092170 | A1 | 5/2004 | Colantuono et al. | |
| 2006/0014410 | A1 * | 1/2006 | Caveney | 439/188 |
| 2007/0015417 | A1 | 1/2007 | Caveney et al. | |
| 2007/0173120 | A1 | 7/2007 | Caveney et al. | |

FOREIGN PATENT DOCUMENTS

| | | | |
|---|---|---|---|
| EP | 1 063 734 | A2 | 12/2000 |
| EP | 1 096 619 | A1 | 5/2001 |
| FR | 2 823 606 | A1 | 10/2002 |
| GB | 2 329 530 | A | 3/1999 |
| WO | WO 2008/005116 | A1 | 1/2008 |

OTHER PUBLICATIONS

International Search Report, International Application No. PCT/US2009/003358, International Filing Date Mar. 6, 2009.

* cited by examiner

*Primary Examiner*—Hae Moon Hyeon

(57) ABSTRACT

An electrical connector includes a housing and a plurality of electrical mating contacts held within the housing. Each of the mating contacts extends from a first end portion to a second end portion. Each of the mating contacts has an intermediate portion extending between the first and second end portions. An electrical compensation component is held within the housing. The electrical compensation component includes a circuit board. The electrical compensation component is electrically connected to at least one of the mating contacts at a location along the intermediate portion that is spaced a distance from the first and second end portions.

20 Claims, 4 Drawing Sheets

ELECTRICAL CONNECTOR WITH COMPENSATION COMPONENT

BACKGROUND OF THE INVENTION

The subject matter herein relates generally to electrical connectors and more particularly to electrical connectors that use compensation components to enhance electrical performance.

Electrical connectors that are commonly used in telecommunication systems provide an interface between successive runs of cables and/or between cables and electronic devices in such systems. Some of such electrical connectors, such as modular jacks, are configured to be joined faith a mating plug and include a contact sub-assembly having a plurality of mating contacts. The mating contacts are arranged according to a known industry standard such as Electronics Industries Alliance/Telecommunications Industry Association ("EIA/TIA")-568. Each of the mating contacts of the contact sub-assembly includes a mating interface that engages a corresponding electrical contact of the mating plug at a mating end portion of the contact sub-assembly. The contact sub-assembly may also include a plurality of wire terminating contacts at a wire terminating end portion of the contact sub-assembly. The wire terminating contacts may be electrically connected to the mating contacts via a circuit board. Connectors such as those described above have traditionally been used for data transmission. The performance of such electrical connectors used for data transmission may be negatively affected by, for example, near-end crosstalk (NeXT) generated by the mated plug and jack interface.

To compensate for the crosstalk, some known techniques have focused on arranging the mating contacts within a housing of the electrical connector to provide desired effects. However, controlled positioning of the mating contacts is difficult to achieve in manufacture or assembly and the electrical connectors tend to have a high amount of variation between different electrical connectors. Other known techniques for compensating for crosstalk include providing a printed circuit board (PCB) that electrically connects the mating and wire terminating contacts with compensation traces that are electrically connected to the mating contacts. However, the compensation traces electrically connect to the mating contacts at end portions thereof that are engaged with the PCB. As the end portions of the mating contacts are located a distance away from the mating interface, there is an electrical delay between the sources of crosstalk and the compensation traces. Such an electrical delay may increase the amount of crosstalk experienced by the electrical connector, thereby reducing the effectiveness that the NeXT compensation stage will cancel out the NeXT loss generated by the mated plug and jack interface.

Thus, a need remains for an electrical connector having a reduced amount of crosstalk relative to at least some other known electrical connectors.

BRIEF DESCRIPTION OF THE INVENTION

In one embodiment, an electrical connector is provided that includes a housing and a plurality of electrical mating contacts held within the housing. Each of the mating contacts extends from a first end portion to a second end portion. Each of the mating contacts has an intermediate portion extending between the first and second end portions. An electrical compensation component is held within the housing. The electrical compensation component includes a circuit board. The electrical compensation component is electrically connected to at least one of the mating contacts at a location along the intermediate portion that is spaced a distance from the first and second end portions.

In another embodiment, an electrical connector is provided that includes a housing and a plurality of mating contacts held within the housing. Each of the mating contacts extends from a first end portion to a second end portion. Each of the mating contacts has an intermediate portion extending between the first and second end portions. A base is held within the housing and at least partially supports the mating contacts. The base includes a plurality of channels that each receives the first end portion of a corresponding one of the mating contacts. A second circuit board is engaged with the second end portion of each of the mating contacts. An electrical compensation component is held within the housing and includes a first circuit board. The electrical compensation component is electrically connected to at least one of the mating contacts at a location along the intermediate portion that is spaced a distance from the first end portion, the second end portion, the second circuit board, and the corresponding channel. In another embodiment, an electrical connector is provided that includes a housing and a plurality of electrical mating contacts held within the housing. Each of the mating contacts extends from a first end portion to a second end portion. A second circuit board is engaged with the second end portion of each of the mating contacts. An electrical compensation component is held within the housing and includes a first circuit board. The electrical compensation component is electrically connected to at least one of the mating contacts at a location along a signal path of the electrical contact that is spaced a distance from the second circuit board.

DETAILED DESCRIPTION OF THE INVENTION

Figure 1:
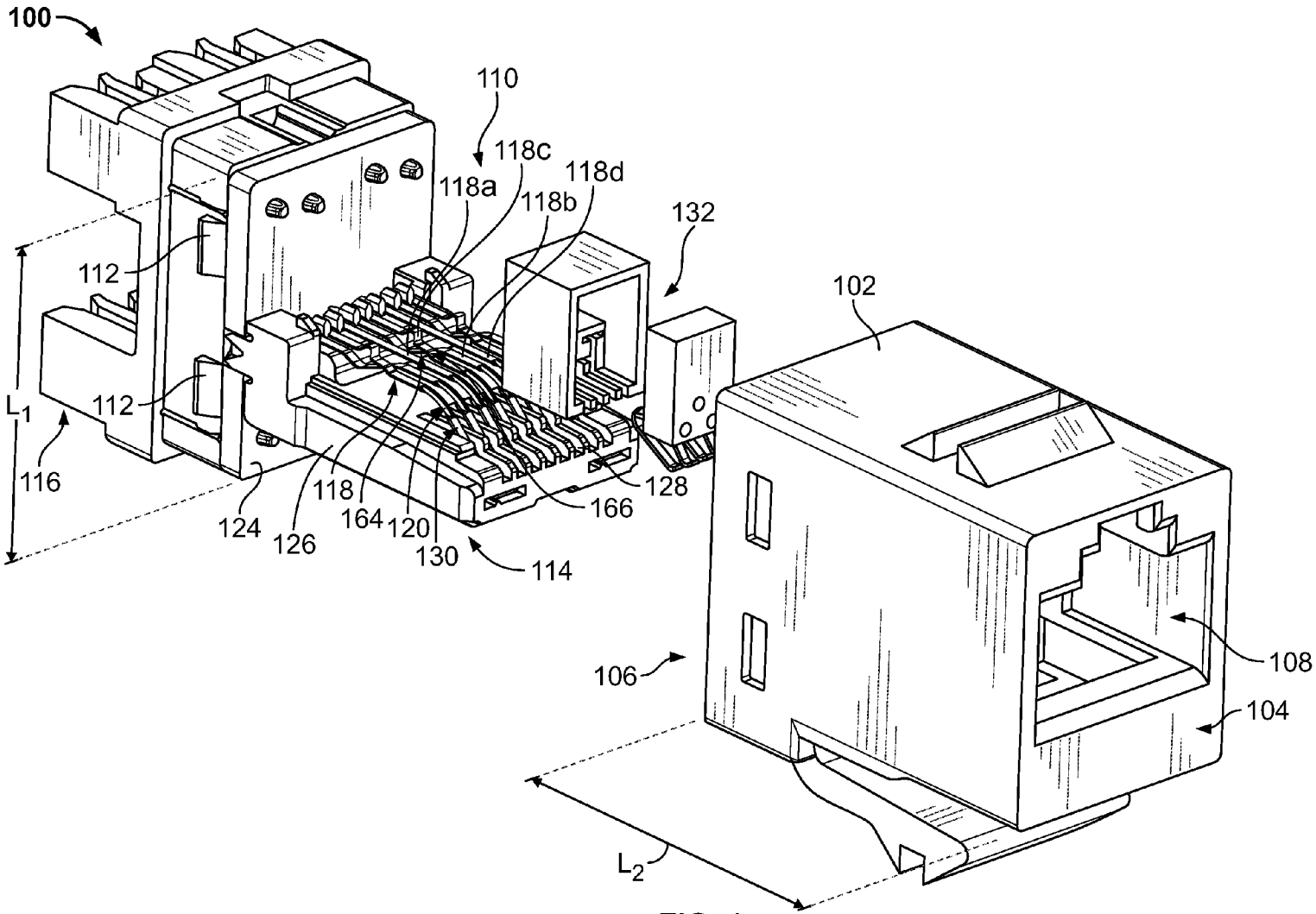
FIG. 1 is an exploded perspective view of an exemplary embodiment of an electrical connector.

FIG. 1 is an exploded perspective view of an exemplary embodiment of an electrical connector 100. In the illustrated embodiment, the connector 100 is a modular connector, such as an RJ-45 jack. The connector 100 is configured for joining with a mating plug (not shown). While the connector 100 is shown and described with reference to an RJ-45 jack, the subject matter herein may be used with other types of connectors, and the RJ-45 jack is merely illustrative of an exemplary embodiment. The connector 100 may be used for data transmission, such as in a telecommunications application. The connector 100 may be used for power transmission, such as in a Power-Over-Ethernet application.

The connector 100 includes a housing 102 extending between a mating end portion 104 and a loading end portion 106. A cavity 108 extends between the mating end portion 104 and the loading end portion 106. The cavity 108 receives the mating plug through the mating end portion 104. The connector 100 includes a contact sub-assembly 110 received within the housing 102 through the loading end portion 106 of the housing 102. In the illustrated embodiment, the contact sub-assembly 110 is secured to the housing 102 via one or more tabs 112. The contact sub-assembly 110 extends between a mating end portion 114 and a wire terminating end portion 116, and is held within the housing 102 such that the mating end portion 114 of the contact sub-assembly 110 is positioned proximate the mating end portion 104 of the housing 102. The wire terminating end portion 116 extends outward, or rearward, from the loading end portion 106 of the housing 102. The contact sub-assembly 110 includes a plurality of electrical mating contacts 118. As will be described below with reference to FIGS. 5 and 6, each mating contact 118 includes a mating interface 120 arranged within the cavity 108 to engage with a corresponding electrical contact (not shown) of the mating plug when the mating plug is joined with the connector 100. The number and/or arrangement of the mating contacts 118 may be controlled by industry standards, such as EIA/TIA-568. In an exemplary embodiment the connector 100 includes eight mating contacts 118 arranged as differential pairs.

The contact sub-assembly 110 includes a plurality of wire terminating contacts 122 (shown in FIGS. 5 and 6) at the wire terminating end portion 116. A circuit board 124 (such as, but not limited to, a printed circuit board (PCB)) electrically connects the wire terminating contacts 122 to corresponding ones of the mating contacts 118 using any suitable structure, means, and/or the like, such as, but not limited to, using traces on one or more surfaces of the circuit board 124, one or more traces embedded within the circuit board 124, and/or the like. In the illustrated embodiment, the circuit board 124 is approximately rectangular in shape, and is oriented approximately vertically within the housing 102 such that a length $L_1$ of the circuit board 124 extends in a direction approximately perpendicular to a length $L_2$ of the housing 102. Alternatively, the circuit board 124 may have other shapes, positions, locations, orientations and/or the like. The circuit board 124 may be referred to herein as a "second circuit board".

A base 126 extends between the mating end portion 114 of the contact sub-assembly 110 and the circuit board 124. The mating contacts 118 are supported by the base 126. In the illustrated embodiment a plurality of parallel channels 128 extends rearward from the mating end portion 114. At least a portion of an end portion 154 (more clearly shown in FIGS. 5 and 6) of each of the mating contacts 118 is received in a corresponding one of the channels 128. Optionally the mating contacts 118 are movable within the channels 128 to allows flexing of the mating contacts 118 as the connector 100 is mated with the mating plug. Each of the mating contacts 118 extends generally parallel to one another and the mating interfaces 120 of each mating contact 118 are generally aligned with one another.

The electrical connector 100 includes at least one electrical compensation component 132 that is configured to electrically connect to at least some of the mating contacts 118. As will be described in more detail below, the electrical compensation component 132 is configured to facilitate controlling the electrical performance of the electrical connector 100.

Figure 4:
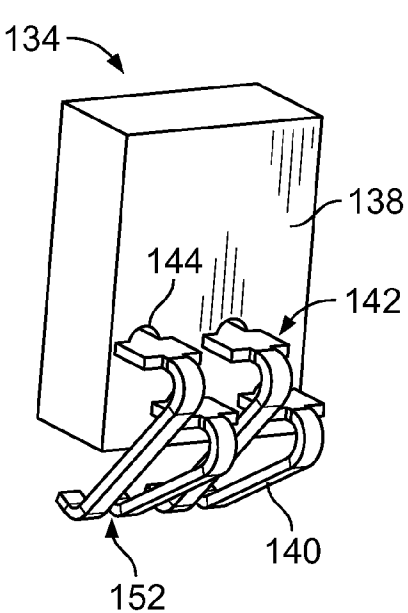
FIG. 4 is a perspective view of the circuit board and electrical contact assembly shown in FIGS. 2 and 3 in an assembled state.
Figure 3:
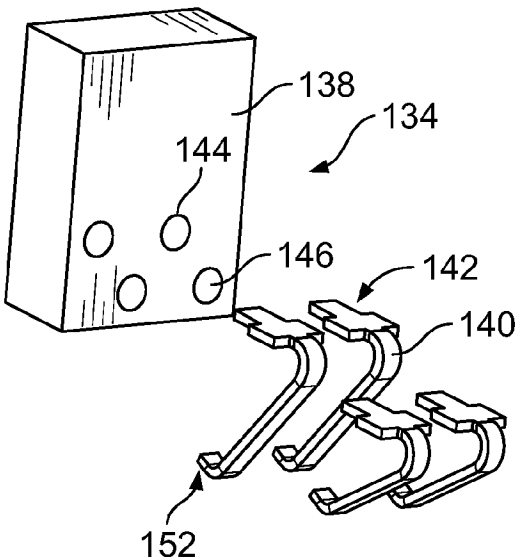
FIG. 3 is an exploded perspective view of an exemplary embodiment of a circuit board and electrical contact assembly of the compensation component shown in FIG. 2.
Figure 2:
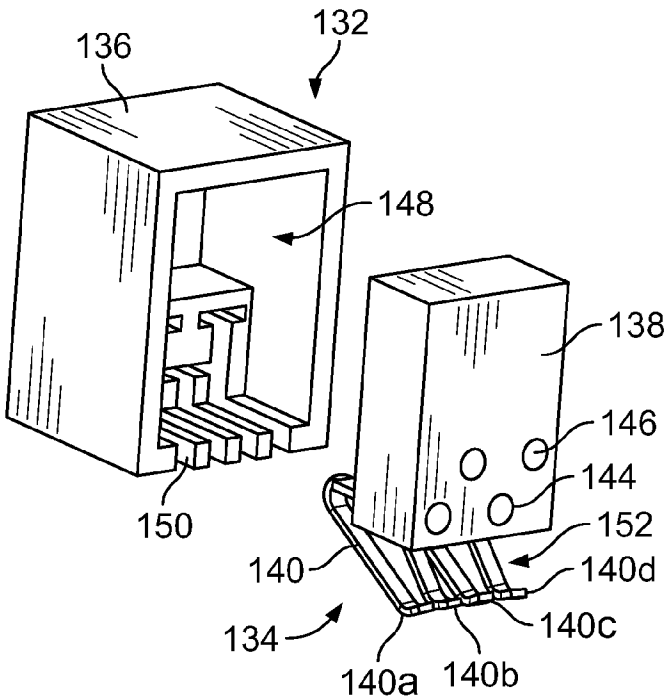
FIG. 2 is a partially exploded view of an exemplary embodiment of a compensation component of the electrical connector shown in FIG. 1.
Figure 5:
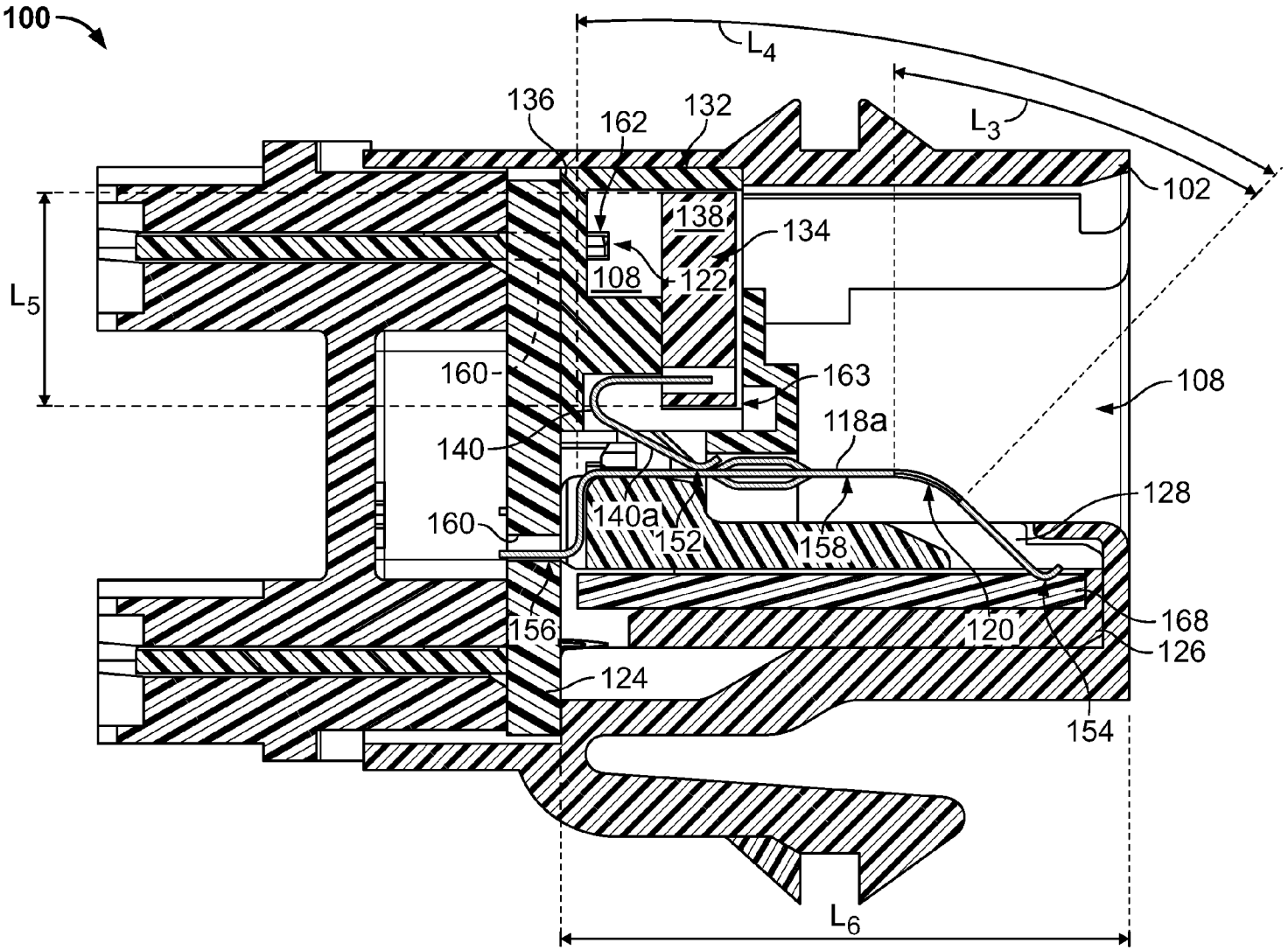
FIG. 5 is a cross-sectional view of the electrical connector shown in FIG. 1.
Figure 6:
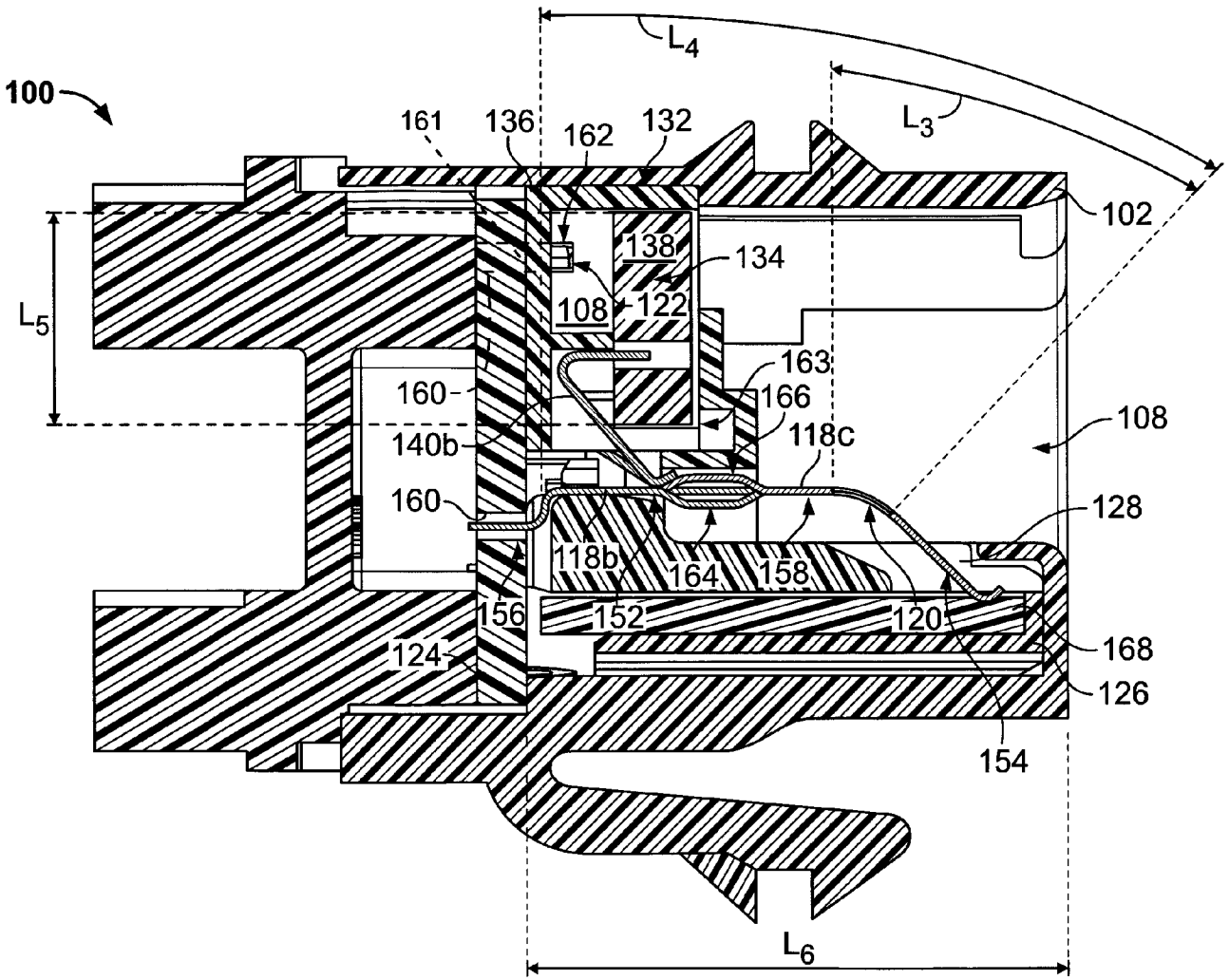
FIG. 6 is another cross-sectional view of the electrical connector shown in FIG. 1.

FIG. 2 is a partially exploded view of an exemplary embodiment of the compensation component 132. FIG. 3 is an exploded perspective view of an exemplary embodiment of a circuit board and electrical contact assembly 134 of the compensation component 132. FIG. 4 is a perspective view of the circuit board and electrical contact assembly 134 in an assembled state. The compensation component 132 includes the circuit board and electrical contact assembly 134 and a housing 136. The circuit board and electrical contact assembly 134 includes a circuit board 138 (such as, but not limited to, a printed circuit board (PCB)) and a plurality of electrical compensation contacts 140. The circuit board 138 may be referred to herein as a "first circuit board". The circuit board 138 may be any suitable type of circuit board, such as, but not limited to a generally rigid circuit board or a generally flexible circuit board. As will be described in more detail below, each of the compensation contacts 140 are configured to be electrically connected to a selected one of the mating contacts 118 (FIGS. 1, 5, and 6). Although four compensation contacts 140 are shown, the circuit board and electrical contact assembly 134 may include any number of compensation contacts 140 for electrically connection to any number of the mating contacts 118.

The circuit board 138 includes one or more compensation elements (not shown) that provide electrical compensation for controlling electrical interactions, such as, but not limited to, by inductive and/or capacitive coupling. The compensation element(s) of the circuit board 138 may be any suitable element that provides the desired electrical compensation, such as, but not limited to, one or more traces on one or more exterior surfaces of the circuit board 138, one or more traces embedded within the circuit board 138, and/or the like. Optionally the compensation elements may be arranged in predetermined orientations to provide compensation or electrical interactions therebetween. The compensation element (s) may be arranged in any suitable arrangement relative to each other, the circuit board 138, the mating contacts 118, and/or the like that provides the desired electrical compensation. The type, number, arrangement, and the like of the compensation element(s), the manner in which the compensation component 132 provides the compensation, and the compensation provided is known in the art and will not be described in further detail herein.

The compensation contacts 140 electrically connect some or all of the mating contacts 118 to corresponding compensation elements of the circuit board 138. The compensation contacts 140 may each be electrically connected to the circuit board 138 using any suitable structure, means, and/or the like that enables the compensation contacts 140 to function as described herein. In the illustrated embodiment, an end portion 142 of each of the compensation contacts 140 electrically and mechanically connects to the circuit board 138 through a corresponding via 144 of the circuit board 138. In addition or alternative to the vias 144, one or more of the compensation contacts 140 may electrically connect to the circuit board using surface mounting. In an exemplary embodiment using the vias 144, the compensation contacts 140 are electrically connected to the corresponding compensation elements through engagement with an electrically conductive material (not shown) on surfaces 146 of the circuit board 138 that define the vias 144. Additionally or alternatively (whether or not the vias 144 are used), the end portion 142 of one or more of the compensation contacts 140 may directly engage the corresponding compensation element(s) of the circuit board 138 and/or may engage an electrically conductive material that is adjacent the corresponding via 144 and that is electrically connected to the corresponding compensation element (s). In addition or alternative to engagement (whether or not the vias 144 are used), solder and/or any other suitable structure, means, and/or the like may optionally be used to form some or all of the electrical connections described in this paragraph. In the illustrated embodiment, the end portions 142 of each of the compensation contacts 140 mechanically connect to the circuit board 138 through an interference fit with the corresponding via 144. In addition or alternative, solder or any other suitable structure, means, and/or the like may be used to mechanically connect one or more of the compensation contacts 140 to the circuit board 138. The compensation contacts 140 may each by any suitable type of electrical contact, having any suitable structure, geometry shape, size, and/or the like that enables the compensation contact 140 to function as described herein.

As will be described in more detail below, the housing 136 holds the circuit board and electrical contact assembly 134 within the cavity 108 (FIGS. 1, 5, and 6) of the electrical connector housing 102 (FIGS. 1, 5, and 6). The housing 136 includes a cavity 148 that receives a portion of the circuit board and electrical contact assembly 134 therein. Although the housing 136 may hold the circuit board and electrical contact assembly 134 within the cavity 148 using any suitable structure, means, and/or the like, in the illustrated embodiment the circuit board and electrical contact assembly 134 is held within the cavity 148 using an interference fit between the housing 136 and the circuit board 138. The housing 136 includes a plurality of slots 150. Each of the compensation contacts 140 extends through a corresponding one of the slots 150 when the circuit board and electrical contact assembly 134 is held within the housing cavity 148. Accordingly end portions 152 of each of the compensation contacts 140 that are opposite the corresponding end portions 142 are held outside the housing cavity 148 when the circuit board and electrical contact assembly 134 is held within the housing cavity 148. Although four slots 150 are shown, the housing 136 may include any number of slots 150 for each receiving any number of the compensation contacts 140.

FIGS. 5 and 6 are cross-sectional views of the electrical connector 100. Each mating contact 118 extends from an end portion 154 to an opposite end portion 156. An intermediate portion 158 extends between the end portions 154 and 156. The end portion 154 may be referred to herein as a "first end portion", while the end portion 156 may be referred to herein as "second end portion". The intermediate portion 158 includes the mating interface 120 described above. As can be seen in FIGS. 6 and 7, the mating interface 120 of each electrical contact extends a length $L_3$. while the intermediate portion 158 extends a length $L_4$ that includes the length $L_3$. A signal path along each mating contact 118 is defined from the mating interface 120 and along the intermediate portion 158 to the end portion 156, or vice versa. The end portion 154 of each mating contact 118 is not part of the signal path of the corresponding mating contact 118.

In the illustrated embodiment, the end portions 156 of each of the mating contacts 118 are electrically and mechanically connected to the circuit board 124 by vias 160 within the circuit board 124, for example similar to that described above with respect to the compensation contacts 140 and the circuit board 138. Additionally or alternatively the end portions 156 of the mating contacts 118 may be electrically and/or mechanically connected to the circuit board 124 using any other suitable structure, means, and/or the like, for example similar to that described above with respect to the compensation contacts 140 and the circuit board 138.

As describe above, the housing 136 holds the circuit board and electrical contact assembly 134 within the cavity 108 of the electrical connector housing 102. Although the housing 136 may hold the circuit board and electrical contact assembly 134 within the cavity 108 using any suitable structure, means, and/or the like, in the illustrated embodiment the housing 136 includes a plurality of openings 161 that each receives an end portion 162 of a corresponding one of the wire terminating contacts 122. The end portions 162 are secured within the openings 161 using an interference fit in the illustrated embodiment. In the illustrated embodiment, the circuit board 138 is approximately rectangular in shape, is held within the housing 102 such that an end portion 163 of the circuit board 138 is located proximate the intermediate portions 158 of each of the mating contacts 118, and is oriented approximately vertically within the housing 102 such that a length $L_5$ of the circuit board 138 extends in a direction approximately perpendicular to a length $L_6$ of the base 126. Alternatively, the circuit board 138 may have other shapes, positions, locations, orientations and/or the like that enable the compensation component 132 to function as described herein.

When the circuit board and electrical contact assembly 134 is held within the cavity 108, the end portion 152 of each of the compensation contacts 140 is engaged with, and thereby electrically connected to, a selected one of the mating contacts 118. Each compensation contact 140 may engage any of the mating contacts 118 to provide a desired electrical compensation. Moreover, any number and/or combination of the mating contacts 118 may be electrically connected to the circuit board 138, via any number of the compensation contacts 140, to provide a desired electrical compensation. Referring to FIGS. 1 and 2, in the illustrated embodiment the circuit board and electrical contact assembly 134 includes four compensation contacts 140*a-d* that each engages a corresponding one of the central four mating contacts 118*a-d*. FIG. 5 illustrates the compensation contact 140*a* engaging the mating contact 118*a*, while FIG. 6 illustrates the compensation contact 140*b* engaging the mating contact 118*b*. In the illustrated embodiment, each of the compensation contacts 140 is a separate component from the corresponding mating contact 118 that is engaged with the corresponding mating contact 118. Alternatively, one or more of the compensation contacts 140 is formed integrally with the corresponding mating contact 118.

Referring again to FIGS. 5 and 6, the end portion 152 of each of the compensation contacts 140 engages the corresponding mating contact 118 at a location along the intermediate portion 158. Each compensation contact 140 is thereby electrically connected to the corresponding mating contact 118 at a location that lies along the signal path of the mating contact 118. The end portions 152 may engage the corresponding mating contact 118 at any location along the intermediate portion 158. In the illustrated embodiment the end portion 152 of each compensation contact 140 engages the corresponding mating contact 118 at a location along the intermediate portion 158 that is spaced a distance from each of the end portions 154 and 156 of the mating contact 118, is spaced a distance from the circuit board 124, and is spaced a distance from the corresponding channel 128. The intermediate portion 158 of some or all of the mating contacts 118 may optionally include a crossover portion that crosses over or under another one of the mating contacts 118. For example, in the illustrated embodiment the mating contact 118*b* includes a crossover portion 164 that crosses under a crossover portion 166 (which crosses over the crossover portion 164) of the mating contact 118*c*, as can be seen in FIGS. 1 and 6. In the illustrated embodiment the end portions 152 of the compensation contacts 140*a* and *b* each engages the intermediate portion 158 of the respective mating contact 118*a* and *b*. The compensation contact 140*b* engages the intermediate portion 158 of the mating contact 118*b* at a location that is proximate the crossover portion 164, and that is closer to the crossover portion 164 than to either of the end portions 154 and 156 of the mating contact 118*b*. Although not shown in FIG. 5 or 6, the compensation contact 140*c* engages the intermediate portion 158 of the mating contact 118*c* at a location that is proximate the crossover portion 166, and that is closer to the crossover portion 166 than to either of the end portions 154 and 156 of the mating contact 118*c*.

The location along the intermediate portion 158 that each compensation contact 140 engages the corresponding mating contact 118 may be selected to provide a desired level of electrical compensation and/or to reduce an electrical delay between the source(s) of crosstalk and the compensation component 132. In some embodiments, the end portion 152 of each compensation contact 140 engages the corresponding mating contact 118 at a location along the intermediate portion 158 that is within approximately 6.50 millimeters of the mating interface 120. Moreover, in some embodiments, the end portion 152 of a compensation contact 140 engages the corresponding mating contact 118 at a location along the intermediate portion 158 that is within approximately 1.90 millimeters of a crossover portion (such as, but not limited to, the crossover portions 164 and/or 166).

In addition to the compensation component 132, the electrical connector 100 may include other compensation components. For example, the circuit board 124 may optionally include one or more compensation elements (not shown) and/or the base 126 may optionally hold a circuit board 168 (such as, but not limited to, a printed circuit board (PCB)) that includes one or more compensation elements (not shown) and that is electrically connected to the end portion 154 of some or all of the mating contacts 118, as can be seen in FIG. 5. The circuit board 168 may be referred to herein as a "second circuit board". In some embodiments, for example as shown in FIG. 6, the end portion 152 of a compensation contact 140 (such as, but not limited to, the compensation contact 140*b*) engages the corresponding mating contact 118 (such as, but not limited to, the mating contact 118*b* at a location along the intermediate portion 158 that is closer to a crossover portion (such as, but not limited to, the crossover portion 164) than to the circuit board 168 and that is closer to a crossover portion than to the circuit board 124.

The embodiments described herein provide an electrical connector that may have a reduced amount of crosstalk relative to at least some other known electrical connectors.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a housing;

a plurality of electrical mating contacts held within the housing, each of the mating contacts extending from a first end portion to a second end portion, each of the mating contacts having an intermediate portion extending between the first and second end portions; and an electrical compensation component held within the housing, the electrical compensation component comprising a circuit board and a compensation contact that is a discrete component from the circuit board, the circuit board comprising a compensation element, the compensation contact being electrically connected to the compensation element and being engaged with a corresponding one of the mating contacts such that the electrical compensation component is electrically connected to the mating contact at a location along the intermediate portion that is spaced a distance from the first and second end portions.

2. The electrical connector according to claim 1, wherein the compensation contact is engaged with the compensation element of the circuit board.

3. The electrical connector according to claim 1, wherein the circuit board is a first circuit board, the electrical connector further comprising a second circuit board engaged with the second end portion of each of the mating contacts, wherein the location is spaced a distance from the second circuit board.

4. The electrical connector according to claim 1, further comprising a base at least partially supporting the mating contacts, the base comprising a plurality of channels that each receives the first end portion of a corresponding one of the mating contacts, wherein the location is spaced a distance from the corresponding channel.

5. The electrical connector according to claim 1, wherein the intermediate portion of each of the mating contacts comprises a mating interface configured to engage a corresponding contact of a mating plug, wherein the location is within approximately 6.50 millimeters of the mating interface.

6. The electrical connector according to claim 1, wherein the intermediate portion of at least one of the mating contacts comprises a crossover portion that crosses over or under another of the mating contacts, wherein the location is within approximately 1.90 millimeters of the crossover portion.

7. The electrical connector according to claim 1, wherein the intermediate portion of at least one of the mating contacts comprises a crossover portion that crosses over or under another of the mating contacts, wherein the location is closer to the crossover portion than to either of the first and second end portions.

8. The electrical connector according to claim 1, wherein the circuit board is a first circuit board, the electrical connector further comprising a second circuit board engaged with the second end portion of each of the mating contacts, the intermediate portion of at least one of the mating contacts comprising a crossover portion that crosses over or under another of the mating contacts, wherein the location is closer to the crossover portion than to the second circuit board.

9. The electrical connector according to claim 1, wherein the intermediate portion of each of the mating contacts comprises a mating interface configured to engage a corresponding contact of a mating plug.

10. The electrical connector according to claim 1, wherein the electrical connector is an RJ-45 jack.

11. The electrical connector according to claim 1, wherein the location lies along a signal path of the mating contact.

12. An electrical connector comprising:

a housing;

a plurality of electrical mating contacts held within the housing, each of the mating contacts extending from a first end portion to a second end portion, each of the mating contacts having an intermediate portion extending between the first and second end portions, wherein the intermediate portion of at least one of the mating contacts comprises a crossover portion that crosses over or under another of the mating contacts; and an electrical compensation component held within the housing, the electrical compensation component comprising a circuit board and being electrically connected to at least one of the mating contacts at a location along the intermediate portion that is proximate the crossover portion.

13. An electrical connector comprising:

a housing;

a plurality of electrical mating contacts held within the housing, each of the mating contacts extending from a first end portion to a second end portion, each of the mating contacts having an intermediate portion extending between the first and second end portions;

a base held within the housing and at least partially supporting the mating contacts, the base comprising a plurality of channels that each receives the first end portion of a corresponding one of the mating contacts;

a second circuit board engaged with the second end portion of each of the mating contacts; and an electrical compensation component held within the housing, the electrical compensation component comprising a first circuit board, wherein the electrical compensation component is electrically connected to at least one of the mating contacts at a location along the intermediate portion that is spaced a distance from the first end portion, the second end portion, the second circuit board, and the corresponding channel.

14. The electrical connector according to claim 13, wherein the electrical compensation component further comprises a compensation contact that electrically connects the first circuit board with the intermediate portion of the mating contact.

15. The electrical connector according to claim 13, wherein the intermediate portion of at least one of the mating contacts comprises a crossover portion that crosses over or under another of the mating contacts, wherein the location is proximate the crossover portion.

16. The electrical connector according to claim 13, wherein the intermediate portion of each of the mating contacts comprises a mating interface configured to engage a corresponding contact of a mating plug, wherein the location is within approximately 6.50 millimeters of the mating interface.

17. The electrical connector according to claim 13, wherein the intermediate portion of at least one of the mating contacts comprises a crossover portion that crosses over or under another of the mating contacts, wherein the location is within approximately 1.90 millimeters of the crossover portion.

18. The electrical connector according to claim 13, wherein the intermediate portion of at least one of the mating contacts comprises a crossover portion that crosses over or under another of the mating contacts, wherein the location is closer to the crossover portion than to the first end portion, is closer to the crossover portion than to the second end portion, and is closer to the crossover portion than to the second circuit board.

19. The electrical connector according to claim 13, wherein the intermediate portion of each of the mating contacts comprises a mating interface configured to engage a corresponding contact of a mating plug.

20. An electrical connector comprising:

a housing;

a plurality of electrical mating contacts held within the housing, each of the mating contacts extending from a first end portion to a second end portion;

a second circuit board engaged with the second end portion of each of the mating contacts; and an electrical compensation component held within the housing, the electrical compensation component comprising a first circuit board, wherein the electrical compensation component is electrically connected to at least one of the mating contacts at a location along a signal path of the mating contact that is spaced a distance from the second circuit board.

* * * * *